US009227441B2

(12) United States Patent
Hasegawa et al.

(10) Patent No.: US 9,227,441 B2
(45) Date of Patent: Jan. 5, 2016

(54) TENSION FLUCTUATION ALLEVIATING DEVICE FOR USE IN FABRIC PRINTING APPARATUS

(71) Applicant: Roland DG Corporation, Hamamatsu-shi, Shizuoka (JP)

(72) Inventors: Hiroaki Hasegawa, Kanazawa (JP); Yutaka Matsuyama, Kanazawa (JP); Koji Yamamura, Kanazawa (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 14/333,719

(22) Filed: Jul. 17, 2014

(65) Prior Publication Data

US 2015/0022606 A1 Jan. 22, 2015

(30) Foreign Application Priority Data

Jul. 18, 2013 (JP) ..... 2013-149488

(51) Int. Cl.

| | |
|---|---|
| ***B41J 2/01*** | (2006.01) |
| ***B41J 15/16*** | (2006.01) |
| ***D06C 3/08*** | (2006.01) |
| ***B41J 3/407*** | (2006.01) |
| ***B65H 23/16*** | (2006.01) |
| *D06C 23/00* | (2006.01) |

(52) U.S. Cl.

CPC ..... *B41J 15/16* (2013.01); *B41J 3/4078* (2013.01); *B41J 15/165* (2013.01); *B65H 23/16* (2013.01); *D06C 3/08* (2013.01); *B65H 2404/563* (2013.01); *B65H 2404/5631* (2013.01); *B65H 2404/621* (2013.01); *B65H 2404/6942* (2013.01); *D06C 23/00* (2013.01)

(58) Field of Classification Search

None

See application file for complete search history.

(56) References Cited

U.S. PATENT DOCUMENTS

| | | | |
|---|---|---|---|
| 3,586,149 | A | 6/1971 | Miller |
| 5,417,413 | A | 5/1995 | Huffman et al. |

(Continued)

FOREIGN PATENT DOCUMENTS

| | | | |
|---|---|---|---|
| EP | 1 780 029 | A1 | 5/2007 |
| JP | 55-19506 | A | 2/1980 |

(Continued)

OTHER PUBLICATIONS

Machine Translation of WO 2012/057097 to Miyashita, Eiji, Mar. 5, 2012, see Sections: Tech Solutions & Description of Embodiments, pp. 6-9.*

(Continued)

*Primary Examiner* — Lisa M Solomon

(74) *Attorney, Agent, or Firm* — Keating and Bennett, LLP

(57) ABSTRACT

A tension fluctuation alleviating device, for use in a fabric printing apparatus including a fabric supplying device, a printing mechanism, a guide between the fabric supplying device and the printing mechanism, and a fabric take-up device, the fabric printing apparatus configured to perform printing on the fabric while intermittently sending the fabric to the printing mechanism, includes a support member provided between the fabric supplying device and the guide device and extending across a width direction of the fabric, and a tension relieving member including an elastically deformable elastic portion supported by the support member and extending from the support member toward the fabric, and a contacting portion closer to the fabric than the elastic portion and contacting with the fabric.

12 Claims, 11 Drawing Sheets

(56) References Cited

U.S. PATENT DOCUMENTS

| | | | |
|---|---|---|---|
| 5,825,374 | A | 10/1998 | Albertalli et al. |
| 6,547,464 | B1 | 4/2003 | Lewis et al. |
| 2002/0044188 | A1 | 4/2002 | Codos |
| 2002/0154202 | A1 | 10/2002 | Yamamoto et al. |
| 2010/0053251 | A1 | 3/2010 | Igarashi et al. |
| 2012/0044309 | A1 | 2/2012 | Wanibuchi et al. |

FOREIGN PATENT DOCUMENTS

| | | | |
|---|---|---|---|
| JP | 9-314879 | A | 12/1997 |
| JP | 2009-090578 | A | 4/2009 |
| JP | 2010-52379 | A | 3/2010 |
| WO | 01/41010 | A1 | 6/2001 |
| WO | WO 2012057097 | A1 * | 5/2012 |

OTHER PUBLICATIONS

Official Communication issued in corresponding European Patent Application No. 14177718.5, mailed on Jan. 26, 2015.

* cited by examiner

TENSION FLUCTUATION ALLEVIATING DEVICE FOR USE IN FABRIC PRINTING APPARATUS

The present application claims priority from Japanese Patent Application No. 2013-149488, filed on Jul. 18, 2013, which is incorporated by reference herein in its entirety.

BACKGROUND OF THE INVENTION

1. Field of the Invention

The present invention relates to a tension fluctuation alleviating device for use in a fabric printing apparatus.

2. Description of the Related Art

A printing apparatus that performs printing on a long printing medium while sending the printing medium intermittently is known. JP 2010-052379 A discloses a printing apparatus including a fabric supplying device primarily having a roll body in which a long printing medium is wound, a printing mechanism including a print head for performing printing on a printing medium supplied from the fabric supplying device, and a delivering roller pair serving as a guide device for guiding the printing medium supplied from the roll body to the printing mechanism. This printing apparatus intermittently feeds the printing medium to the printing mechanism by the intermittent rotation of delivering rollers, which constitute the delivering roller pair.

JP 2009-090578 A discloses a printing apparatus including a fabric supplying device for supplying a printing medium, a printing mechanism including a recording head for performing printing on the printing medium supplied from the fabric supplying device, a platen roller provided between the fabric supplying device and the printing mechanism and serving as a guide device for guiding the printing medium toward the printing mechanism, and a take-up roller for taking up the printing medium that has been printed by the printing mechanism.

SUMMARY OF THE INVENTION

In the printing apparatus disclosed in JP 2009-090578, only the take-up roller is driven in the direction corresponding to the travelling direction of the printing medium. This means that, when the printing apparatus of JP 2009-090578 is used to perform printing on the printing medium intermittently as in the case of JP 2010-052379, the take-up roller is driven intermittently so as to pull the printing medium from the downstream side of the printing apparatus intermittently by a predetermined amount each time.

In the printing apparatus of JP 2009-090578, the take-up roller is driven to pull the printing medium, causing a supply roller to be indirectly driven so that the printing medium is sent out from the supply roller. Consequently, in the case where the printing medium is intermittently printed as described above, the supply roller is repeated rotated and stopped.

In that case, the supply roller, which is indirectly driven, causes an operation delay relative to the take-up roller, which is driven, at the time of rotating and at the time of halting because of inertia. This means that, when the printing medium is fabric, the tension of the fabric fluctuates repeatedly. Because fabric has elasticity unlike paper and the like, the fabric expands and contracts because of the tension fluctuation, causing printing misalignment in printing by the printing mechanism. Thus, it is difficult to perform high resolution printing with the conventional printing apparatus when it is necessary to perform printing intermittently on a fabric material, which has elasticity.

Accordingly, preferred embodiments of the present invention significantly reduce or prevent fabric tension fluctuations in a fabric printing apparatus, so as to prevent printing misalignment and to make high resolution printing possible.

A tension fluctuation alleviating device according to a preferred embodiment of the present invention is preferably for use in a fabric printing apparatus including a fabric supplying device configured to supply a long fabric, a printing mechanism configured to perform printing on the fabric supplied from the fabric supplying device, a guide device provided between the fabric supplying device and the printing mechanism and configured to guide the fabric toward the printing mechanism, and a fabric take-up device configured to take up the fabric printed by the printing mechanism, the fabric printing apparatus configured to intermittently send the fabric to the printing mechanism to perform printing on the fabric. The tension fluctuation alleviating device preferably includes a support member located between the fabric supplying device and the guide device and extending across a width direction of the fabric; and a tension relieving member including an elastically deformable elastic portion supported by the support member and extending from the support member toward the fabric, and a contacting portion being positioned closer to the fabric than the elastic portion and making contact with the fabric.

The tension relieving member may include a tubular elastic material.

It should be noted that the elastic portion in the tension relieving member may or may not be configured integrally across the width direction, and the contacting portion also may or may not be configured integrally across the width direction. However, the tension of the fabric is not necessarily constant across the width direction thereof. In order that the tension of the fabric may be as uniform as possible across the width direction even when it is not constant, the following configurations are desirable.

In one preferred embodiment of the present invention, the elastic portion and the contacting portion preferably are integrated with each other, at least a portion of the elastic portion connected to the contacting portion preferably is divided in a width direction, and the contacting portion preferably includes a plurality of partial contacting portions corresponding to the divided portions of the elastic portion.

The plurality of partial contacting portions preferably are arrayed in the width direction with no gaps therebetween. The plurality of partial contacting portions preferably are arrayed so as to be spaced apart from each other in the width direction.

When a portion of the elastic portion is divided in the width direction into a plurality of portions, a remaining portion of the elastic portion other than the divided portion thereof may or may not be integrally configured along the width direction. However, when it is taken into consideration that the elastic portion is made easier to handle so as to reduce the workload necessary in manufacturing the tension fluctuation alleviating device, it is preferable that the elastic portion include a plurality of elastic portions lined up in the width direction and each supported by the support member.

The tension relieving member may include only the elastic portion and the contacting portion. However, taking large tension fluctuations of the fabric into consideration, it is possible to use or adopt the following configuration. In another preferred embodiment of the present invention, the tension relieving member preferably includes a supplementary elastic portion supported by the support member, and the distance from the support member to an edge portion of the supplementary elastic portion on the fabric side preferably is shorter than the distance from the support member to an edge portion of the contacting portion on the fabric side.

The manner of supporting the support member not limited in any way. For example, the opposite end portions of the support member preferably are supported by a support frame or the like of the fabric printing apparatus. The support member preferably is mounted to the support frame or the like so that its mounting condition is unchangeable. However, the mounting condition thereof preferably is changeable so that the elasticity of the elastic portion against the fabric can be changed. The support member preferably is configured so that the installation position thereof is changeable around an axial line parallel to the width direction of the fabric. The support member preferably is configured to be rotatable around an axial line parallel or substantially parallel to the width direction of the fabric.

Various preferred embodiments of the present invention make it possible to alleviate fabric tension fluctuations in a fabric printing apparatus. Therefore, printing misalignment is prevented, and high resolution printing is made possible.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
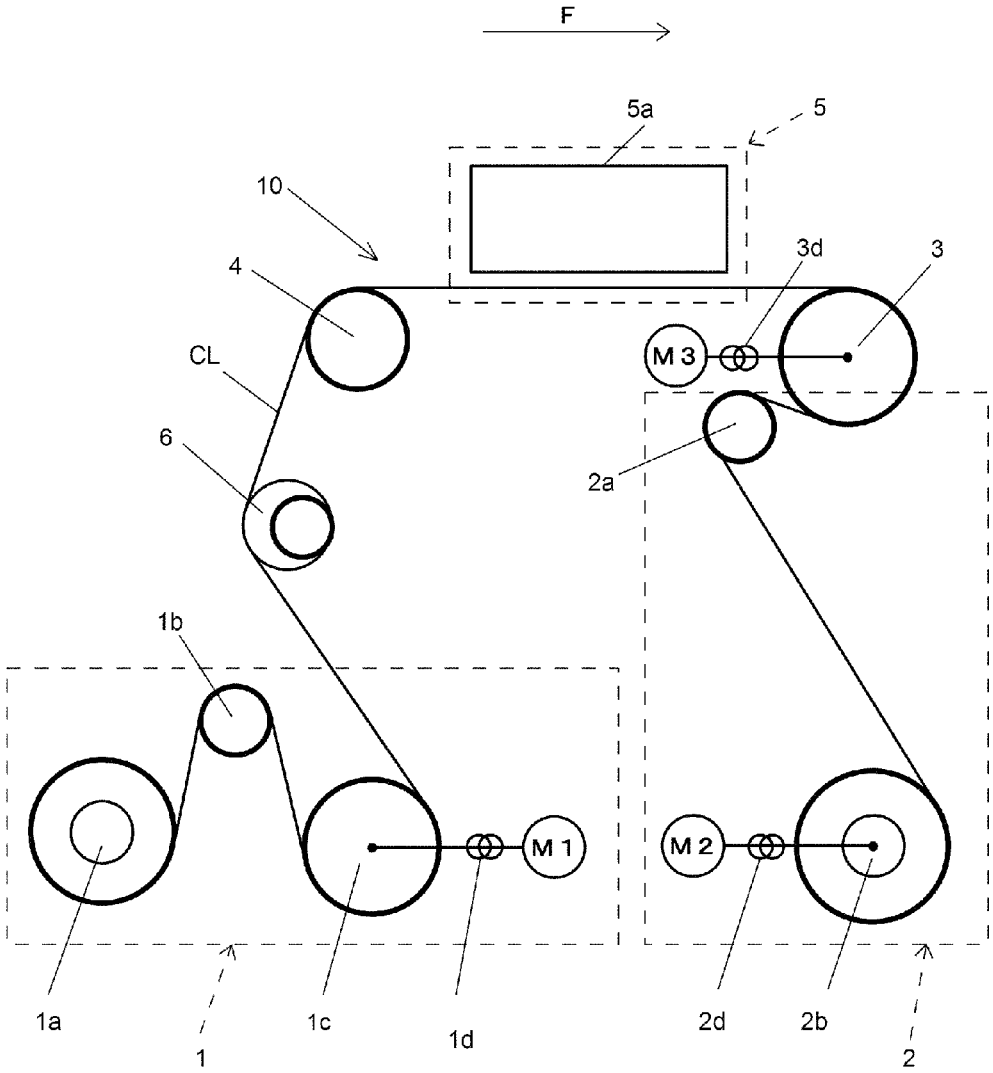
FIG. 1 is a side view illustrating the arrangement of a fabric printing apparatus according to a preferred embodiment of the present invention.

FIG. 1 shows a fabric printing apparatus 10 in which a tension fluctuation alleviating device 6 according to a preferred embodiment of the present invention is provided, and it schematically illustrates the positional relationship among various elements of the fabric printing apparatus 10. In the following description, the term "downstream side" refers to the downstream side in terms of the direction of travel of a fabric CL, and the term "upstream side" refers to the upstream side in terms of the direction of travel of the fabric CL. Reference character F in FIG. 1 indicates the feeding direction of the fabric CL.

As illustrated in FIG. 1, the fabric printing apparatus 10 (hereinafter simply referred to as "printing apparatus") includes a fabric supplying device 1 configured to supply a fabric CL as a printing medium, a printing mechanism 5 configured to perform printing on the fabric supplied from the fabric supplying device 1, a support roll 4 disposed on the downstream side of the fabric supplying device 1 (i.e., between the fabric supplying device 1 and the printing mechanism 5 in the path of the fabric CL) and defining a guide device configured to guide the fabric CL to change its direction toward the printing mechanism 5, a feed roll 3 disposed on the downstream side of the printing mechanism 5 and configured to intermittently move the fabric CL, and a fabric take-up device 2 disposed on the downstream side of the feed roll 3 and configured to take up the fabric CL that has been printed.

After having been fed from the fabric supplying device 1, the fabric CL is wrapped around the support roll 4 to change its direction and is guided toward the printing mechanism 5. The fabric CL is printed by the printing mechanism 5. Thereafter, the fabric CL is wrapped around the feed roll 3 to change its direction toward the fabric take-up device 2 and to send it in the travelling direction by intermittent rotation of the feed roll 3. Then, the fabric CL is taken up by the fabric take-up device 2. The details of the elements and components are as follows.

The fabric supplying device 1 includes a supply roll 1*a* around which the fabric CL is wound, a sending roll 1*c* configured to pull the fabric CL out of the supply roll 1*a* and send it to the downstream side, and a feeding-side guide roll 1*b* provided between the supply roll 1*a* and the sending roll 1*c*. The fabric CL pulled out from the supply roll 1*a* is wrapped around the feeding-side guide roll 1*b*, which guides the fabric CL toward the sending roll 1*c*. Each of these rolls 1*a*, 1*b*, and 1*c* is rotatably supported at shaft portions (not shown) provided at the opposite ends thereof via bearings or the like, by a pair of support frames (not shown) disposed spaced apart in the axial line of each of the rolls 1*a*, 1*b*, and 1*c*. In the present preferred embodiment, the sending roll 1*c* is driven in order to actively feed the fabric CL. A feeding motor M1, which is a servomotor, is coupled to one of the shaft portions of the sending roll 1*c* via a drive force transmission mechanism 1*d* including a gear train or the like. The sending roll 1*c* is driven and rotated by the feeding motor M1.

The support roll 4 is configured to guide the fabric CL toward the printing mechanism 5, which is positioned above the fabric supplying device 1. The support roll 4 is disposed above the fabric supplying device 1 and upstream of the printing mechanism 5. Like each of the rolls 1*a*, 1*b*, and 1*c*, the support roll 4 is supported at the opposite ends thereof by the support frames. The fabric CL that is fed upwardly from the fabric supplying device 1 is wrapped around the support roll 4. As a result, the support roll 4 causes the fabric CL to change its direction toward the printing mechanism 5. In the present preferred embodiment, the support roll 4 is supported non-rotatably relative to the support frames in order to prevent vertical displacement of the fabric CL in association with the rotation of the support roll 4. However, the support roll 4 may be supported rotatably relative to the support frames.

In the example shown in the figure, the feed roll 3 preferably has the same or substantially the same diameter as the sending roll 1*c* in the fabric supplying device 1. Regarding the vertical direction, the position of the top end of the feed roll 3 is in agreement with the position of the top end of the support roll 4. This means that the portion of the fabric CL that is supported by the feed roll 3 and the support roll 4 is set horizontal. The feed roll 3 is supported rotatably relative to the support frame by the shaft portions (not shown) provided at opposite ends thereof via bearings or the like. The feed roll 3, which is driven, is configured to perform an intermittent conveying operation in the travel direction of the fabric CL. A drive motor M3, which is a servomotor, is coupled to one of the shaft portions of the feed roll 3 through a drive force transmission mechanism 3*d* including a gear train or the like. The feed roll 3 is driven and rotated by the drive motor M3.

The fabric take-up device 2 includes a take-up roll 2*b* disposed below the feed roll 3, to take up the fabric CL, and a take-up-side guide roll 2*a*. The take-up-side guide roll 2*a* is provided upstream of the take-up roll 2*b* and near the circumferential surface of the feed roll 3. The fabric CL that is fed from the feed roll 3 is wrapped around the take-up-side guide roll 2*a*, which guides the fabric CL to the take-up roll 2*b*. Each of these rolls 2*a* and 2*b* is supported rotatably on the support frame, at the shaft portions (not shown) provided at opposite ends thereof via bearings or the like. While the take-up roll 2*b* is being driven, the rotation torque thereof is controlled according to the roll diameter (i.e., the diameter of the fabric CL wound around the take-up roll 2*b*) in order to take up the fabric CL at a predetermined tension. A take-up motor M2, which is a torque motor, is coupled to one of the shaft portions of the take-up roll 2*b* through a drive force transmission mechanism 2*d* including a gear train or the like. The take-up roll 2*b* is driven and rotated by the take-up motor M2.

The printing mechanism 5 is disposed between the support roll 4 and the feed roll 3. The printing mechanism 5 is provided with a print head 5*a*, which is disposed above the fabric CL. The printing mechanism 5 includes the print head 5*a*. The print head 5*a* preferably is a known inkjet-type print head. The print head 5*a* injects ink while travelling in a width direction of the fabric CL (in a direction perpendicular to the drawing sheet of FIG. 1) to perform printing on the fabric CL. The print head 5*a* is provided with nozzles corresponding to the inks of the colors to be used. The inks supplied from the ink cartridges (not shown) for the respective colors to the respective nozzles are injected from the respective nozzles by ink injecting devices (not shown).

The printing apparatus 10 performs printing in the following procedures 1) through 3). In the following procedures, it is assumed that the feeding motor M1 and the drive motor M3 are driven in accordance with a predetermined speed pattern.

1) The print head 5*a* travels in a width direction of the fabric CL under the condition in which the fabric CL is halted (i.e., the feeding motor M1 and the drive motor M3 are halted) to perform printing on the fabric CL over a predetermined print range along the front-rear direction. It should be noted that the front-rear direction is the direction defined on the assumption that the fabric take-up device 2 is in the front and the fabric supplying device 1 is at the rear of the printing apparatus 10.

2) After the print operation by the print head 5*a* is completed one time, the drive motor M3 drives the feed roll 3. This allows the feed roll 3 to rotate, so as to perform a conveying operation of the fabric CL. At the same time, the feeding motor M1 drives the sending roll 1*c*. This allows the sending roll 1*c* to rotate, so as to perform a feeding operation of the fabric CL toward the printing mechanism 5.

3) When the conveying operation of the fabric CL is completed, in other words, when the drive motor 3 stops and thus the rotation of the feed roll 3 stops, the feeding operation of the fabric CL is also completed. Thereafter, the print operation described in the foregoing 1) is executed again, and thereafter, this series of processes is repeated. By repeating the above-described operations intermittently, the feeding motor M1 and the drive motor M3 cause the fabric CL to move by a predetermined amount each time so that the intermittent feeding of the fabric CL to the printing mechanism 5 is achieved.

In addition, the torque of the take-up motor M2 is controlled so that the tension will be constant when taking up the fabric CL that has been printed. More specifically, the torque of the take-up motor M2 is adjusted according to the roll diameter of the take-up roll 2*b*, which takes up the fabric CL that has been printed. Thus, the take-up motor M2 and the take-up roll 2*b* are configured to take up the fabric CL that has been sent out from the feed roll 3 at a predetermined tension. This makes it possible to prevent creases from occurring when taking up the fabric CL.

The tension fluctuation alleviating device 6 is provided between the fabric supplying device 1 and the support roll 4. The tension fluctuation alleviating device 6 according to the present preferred embodiment is disposed at substantially the midpoint between the sending roll 1*c* and the support roll 4 in the fabric supplying device 1. The tension fluctuation alleviating device 6 is provided at a position shifted toward the supply roll 1*a* regarding the front-rear direction (i.e., shifted rearward) relative to the linear path of the fabric CL between the support roll 4 and the sending roll 1*c*. Therefore, the fabric CL that is fed from the sending roll 1*c* travels toward the tension fluctuation alleviating device 6 through a path that deviates from the linear path toward the supply roll 1*a* regarding the front-rear direction. The fabric CL is fed through the path passing through the tension fluctuation alleviating device 6 toward the support roll 4. Hereinbelow, the configuration of the tension fluctuation alleviating device 6 according to the present preferred embodiment will be described with reference to FIGS. 2*a* through 4*c*.

The tension fluctuation alleviating device 6 includes a cylindrical support member 7 and a tension relieving member 8 that is preferably made by forming a thin plate shaped metallic elastic material into a tubular shape, for example.

A female thread hole (not shown) in which a mounting bolt 12 configured to mount the tension relieving member 8 to the support member 7 is to be inserted is provided at a mounting position for the tension relieving member 8 in the outer circumferential surface of the support member 7.

As described above, the tension relieving member 8 is a member preferably made by forming a thin plate shaped metallic elastic material into a tubular shape, for example. Therefore, the cross-sectional shape thereof is circular or substantially circular, for example. The tension relieving member 8 is such that the elasticity thereof changes by changing the material, thickness, and curvature of the thin plate shaped metal. The tension relieving member 8 is configured so that the inner diameter thereof is greater than that of the support member 7, and the support member 7 is configured to be inserted into the inside (into a hollow portion 8*z*). The tension relieving member 8 has, at a predetermined position in the circumferential surface thereof, a hole (not shown) in which a male screw portion (not shown) of the mounting bolt 12 is to be inserted. With the support member 7 being inserted in the hollow portion 8*z* of the tension relieving member 8, the male screw portion of the mounting bolt 12 is inserted into the hole, and the male screw portion of the mounting bolt 12 is also inserted into the female thread hole of the support member 7. Thus, the tension relieving member 8 is mounted to the support member 7 so that a portion of the inner circumferential surface of the tension relieving member 8 is in contact with the outer circumferential surface of the support member 7. The tension relieving member 8 is in a decentered condition relative to the support member 7.

In the present preferred embodiment, a retainer 15 having a circular or substantially circular arc shaped cross section is interposed between a head portion 12*a* of the mounting bolt 12 and the tension relieving member 8. The tension relieving member 8 is mounted to the support member 7 so as to be sandwiched between the outer circumferential surface of the support member 7 and the inner side face of the retainer 15. More specifically, the retainer 15 has a through-hole (not shown), in which the male screw portion of the mounting bolt 12 is to be inserted, formed therein. To mount the tension relieving member 8 to the support member 7, first, the male screw portion of the mounting bolt 12 is inserted into the through-hole of the retainer 15, and thereafter, the male screw portion of the mounting bolt 12 is inserted into the above-mentioned hole of the tension relieving member 8. Under such conditions, the male screw portion of the mounting bolt 12 is inserted into the female thread hole of the support member 7. Thus, the tension relieving member 8 is secured to the support member 7 so as to be clamped between the outer circumferential surface of the support member 7 and the retainer 15.

The length of the tension relieving member 8 (the dimension thereof along the width direction of the fabric CL, in other words, the dimension thereof along the direction in which the tension relieving member 8 extends) is shorter than the length of the support member 7. The tension relieving member 8 is mounted to the support member 7 so that the end portions of the support member 7 protrude from the opposite ends of the tension relieving member 8 along its extending direction. It should be noted, however, that the length of the tension relieving member 8 preferably is longer than the widthwise dimension of the fabric CL. Therefore, the length of the tension relieving member 8 and that of the support member 7 are determined taking the widthwise dimension of the fabric CL into consideration.

The tension relieving member 8 is preferably made only of the thin plate shaped metallic elastic material, and it is preferably configured so that the tubular elastic material makes direct contact with the fabric CL. In the present preferred embodiment, a portion of the tubular elastic material that makes contact with the fabric CL corresponds to a contacting portion 81, and the remaining portion other than the contacting portion 81 (the portion thereof that is nearer to the support member 7 than the contacting portion 81) corresponds to an elastic portion 82. In the present preferred embodiment, the tension relieving member 8 is such that the contacting portion 81 and the elastic portion 82 preferably are formed integrally with each other, for example. Moreover, the tension relieving member 8 of the present preferred embodiment has a circular or substantially circular cross-sectional shape. Therefore, it has such a configuration that elastic portions 82, 82 extend separately from both ends of the contacting portion 81 along the circumferential direction; in other words, it has such a configuration that a pair of elastic portions 82, 82 are present for one contacting portion 81.

In the present preferred embodiment, the regions of the contacting portion 81 and the elastic portion 82 along the circumferential direction are set as follows. First, the region in which the tension relieving member 8 makes contact with the fabric CL changes according to the elastic deformation of the tension relieving member 8, which is associated with the tension fluctuation of the fabric CL. Therefore, in the case where the contacting portion 81 and the elastic portion 82 are formed integrally with each other as in the present preferred embodiment, the region that makes contact with the fabric CL under the condition in which the tension relieving member 8 has been elastically deformed to a maximum extend (under the condition shown in FIG. 4*c*) is defined as the contacting portion 81, while the region excluding the portion that makes contact with the fabric CL under that condition is defined as the elastic portion 82. It should be noted that the tension relieving member 8 is in a decentered condition relative to the support member 7, as described previously. Therefore, depending on the mounting condition of the tension relieving member 8, the contacting portion of the tension relieving member 8 against the fabric CL may be different. Thus, the position of the contacting portion 81 of the tension relieving member 8 of the present preferred embodiment may be different depending on the mounting condition of the tension relieving member 8.

Figure 2A:
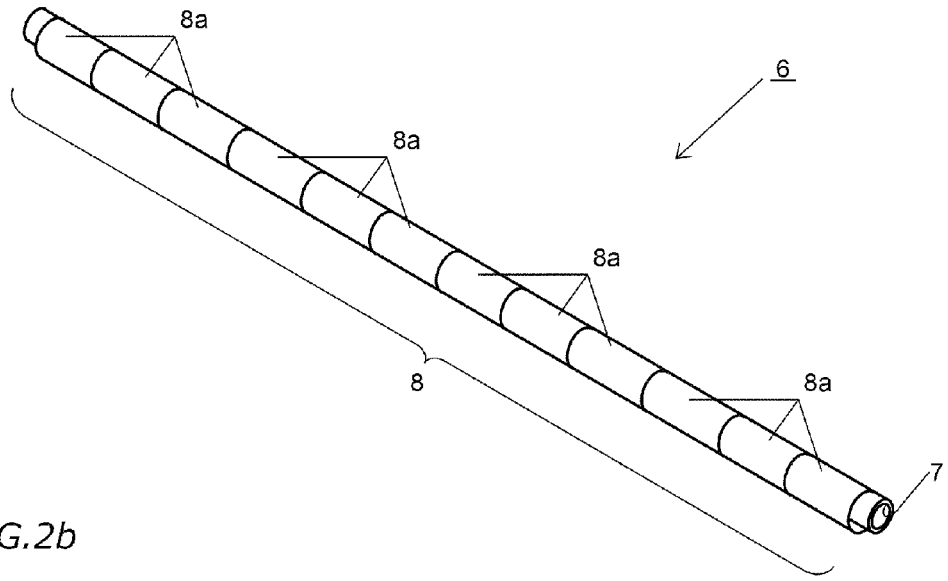
FIG. 2*a* is a perspective view illustrating a tension fluctuation alleviating device according to a preferred embodiment of the present invention.
Figure 2B:
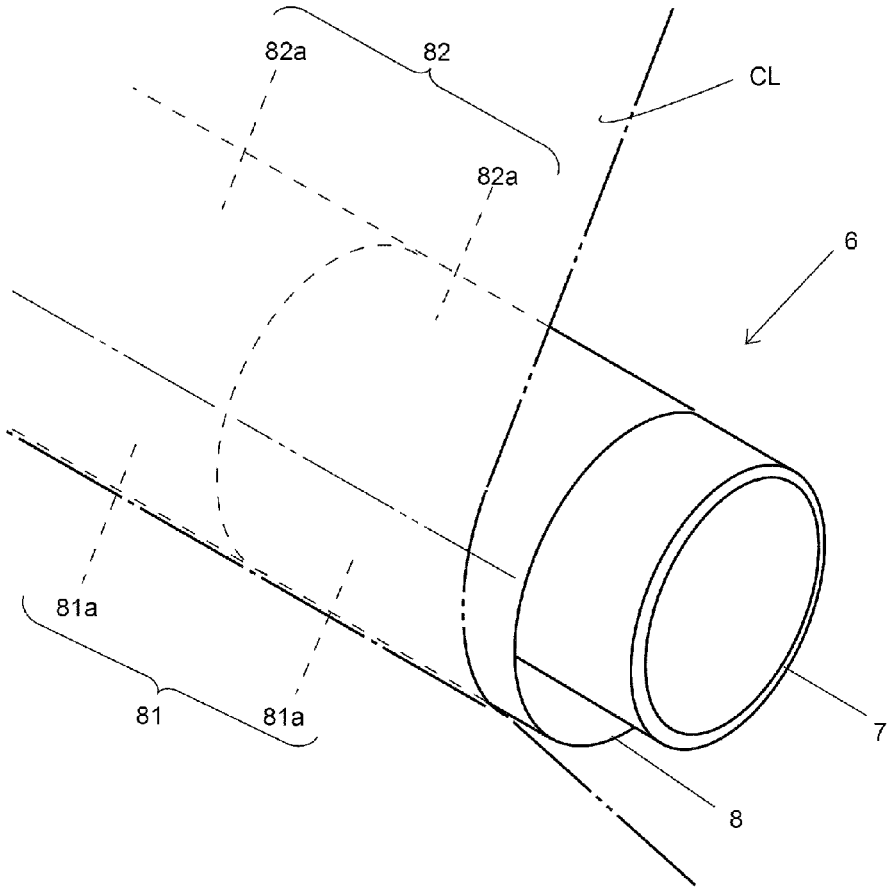
FIG. 2*b* is a perspective view illustrating a portion of the tension fluctuation alleviating device enlarged.
Figure 3:
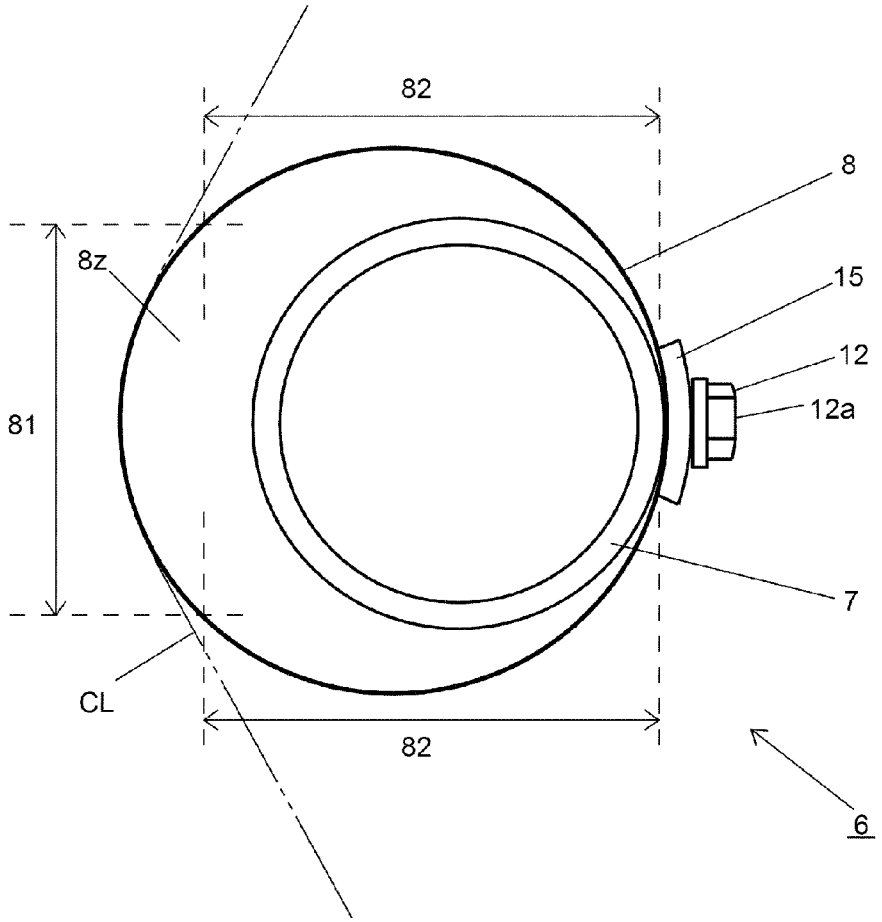
FIG. 3 is a side view of the tension fluctuation alleviating device.

In the present preferred embodiment, as illustrated in FIGS. 2*a* and 2*b*, the tension relieving member 8 is divided into a plurality of portions across its longitudinal direction (i.e., the width direction of the fabric CL, which is hereinafter referred to as "width direction"). More specifically, the tension relieving member 8 includes a plurality of tubular members 8*a* that are juxtaposed in the width direction. The tubular members 8*a* are preferably made of an elastic material. The dimension of each of the tubular members 8*a* along the width direction (the widthwise dimension) is smaller than the entire widthwise dimension of the tension relieving member 8. Where the number of the tubular members 8*a* is n (n is an integer equal to or greater than 2), the widthwise dimension of the tubular member 8 is 1/n of the entire widthwise dimension of the tension relieving member 8. In the present preferred embodiment, the diameters of the tubular members 8*a* preferably are the same or substantially the same.

In the tension relieving member 8 of the present preferred embodiment, the contacting portion 81 of the tension relieving member 8 is preferably formed by combining the portions of the tubular members 8*a* that make contact with the fabric CL (hereinafter referred to as "partial contacting portions 81*a*") with each other. The elastic portion 82 of the tension relieving member 8 is preferably formed by combining the portions of the tubular members 8*a* excluding the partial contacting portions 81*a* (hereinafter referred to as "partial elastic portions 82*a*") with each other. In other words, the contacting portion 81 and the elastic portion 82 of the tension relieving member 8 according to the present preferred embodiment are divided into units of the above-described tubular members 8*a*. Note that the tubular members 8*a* are mounted to the support member 7 independently from each other. More specifically, each of the tubular members 8*a* has two or more holes formed therein, and each of the tubular members 8*a* is secured to the support member 7 by the mounting bolts 12 that are inserted into these holes.

Figure 5:
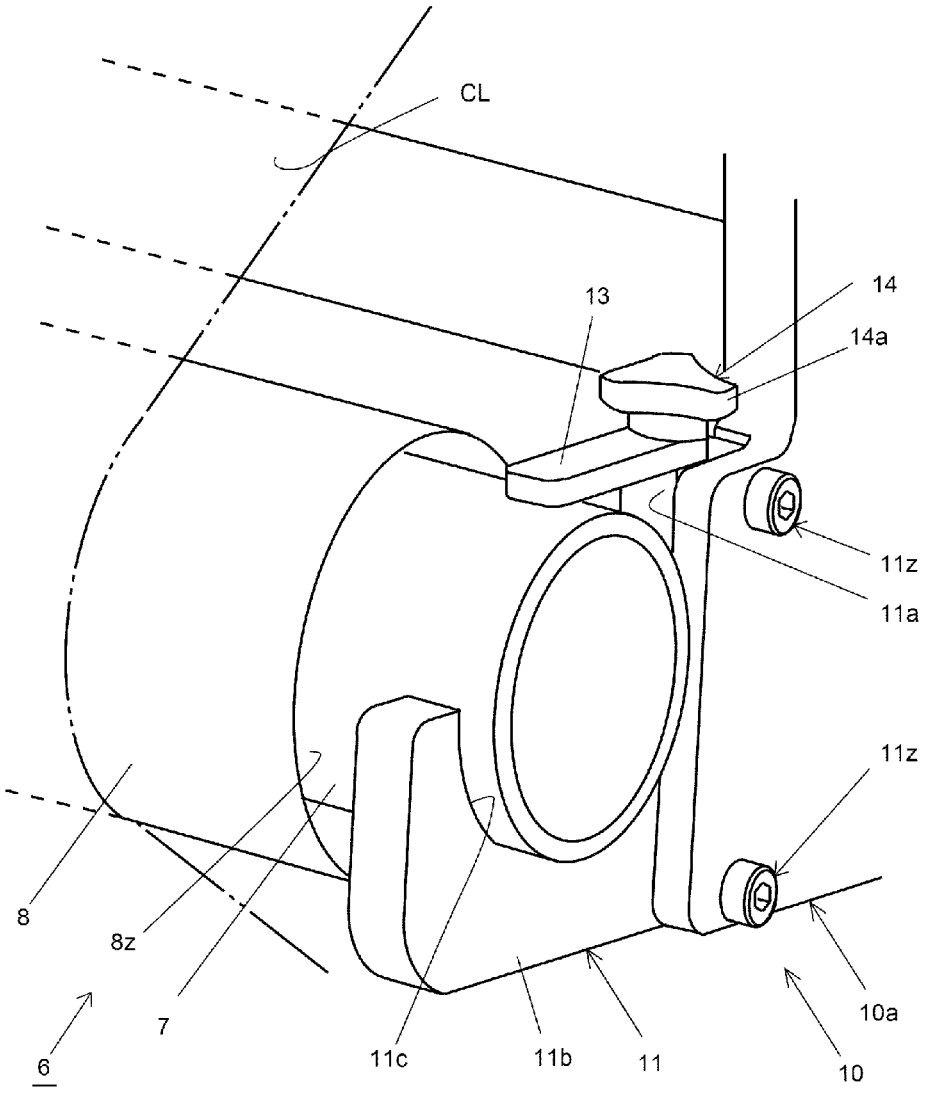
FIG. 5 is a perspective view illustrating a portion of the tension fluctuation alleviating device.
Figure 6A:
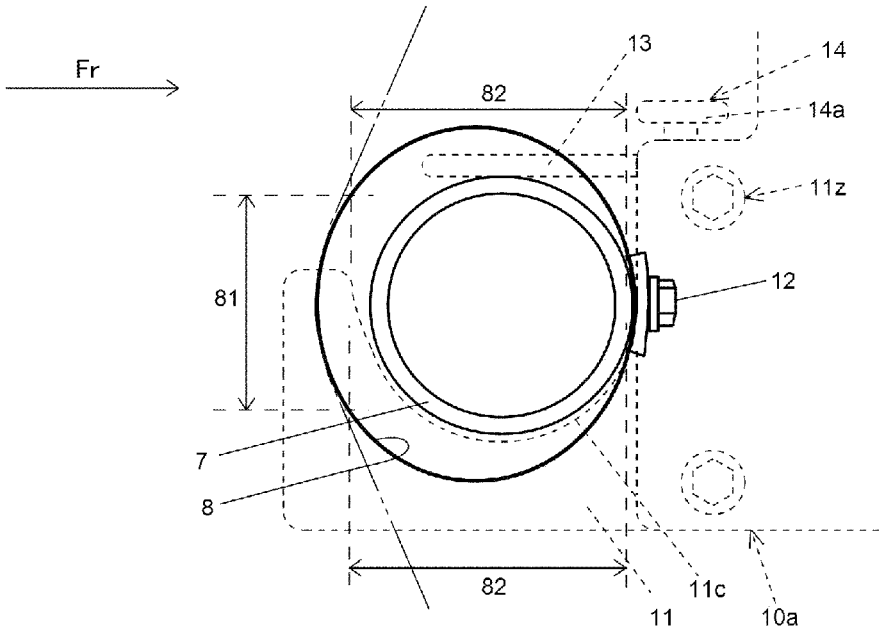
FIG. 6*a* is a side view of the tension fluctuation alleviating device.

As illustrated in FIGS. 5 and 6*a*, the printing apparatus 10 includes a pair of support frames 10*a*, 10*a* (FIG. 5 depicts only one of them). The pair of support frames 10*a*, 10*a* are disposed spaced apart from each other in the width direction of the fabric CL. The support member 7 has a length sufficient to span between the pair of support frames 10*a*, 10*a*. The tension relieving member 8 is supported by the pair of support frames 10*a*, 10*a* via the support member 7, so as to span between the pair of support frames 10*a*, 10*a*.

Each of the support frames 10*a* has a support bracket 11 configured to support the support member 7 and to receive the support member 7, and a restricting member 13 configured to restrict rotation and vertical displacement of the support member 7.

The support bracket 11 is preferably defined by an L-shaped plate member. The support bracket 11 includes a portion that extends upwardly (hereinafter referred to as an "upwardly extending portion 11*a*"), and a portion that extends rearward from the a lower portion of the upwardly extending portion 11*a*, that is, a portion that extends rearwardly from the rear end of the corresponding support frame 10*a* (hereinafter referred to as a "rearwardly extending portion 11*b*"). The support bracket 11 is disposed so as to overlap the support frame 10*a* in the width direction. The upwardly extending portion 11*a* is secured to the support frame 10*a* by a bolt 11*z*, for example. The rearwardly extending portion 11*b* includes a catch portion 11*c* recessed in a circular or substantially circular arc shape so as to be capable of catching the support member 7. The catch portion 11*c* of the support bracket 11 catches one of the opposite ends of the support member 7. Each of the opposite ends of the support member 7 is supported by the respective support frame 10*a* through the respective support bracket 11.

The flat-plate-shaped restricting member 13, which extends rearwardly, is fitted to the upper end of the upwardly extending portion 11*a* of each of the support brackets 11. The restricting member 13 is configured to restrict rotation and vertical displacement of the support member 7, which is placed in the catch portion 11*c* of the support bracket 11. The restricting member 13 is fitted to the support bracket 11. Regarding the vertical direction, the restricting member 13 is disposed so that the lower surface of the restricting member 13 makes contact with the top end of the support member 7. Thus, the support member 7 is placed in the circular or substantially circular arc-shaped catch portion 11*c* of the support bracket 11 and the top end thereof is in contact with the restricting member 13. As a result, the support member 7 is supported by the support brackets 11 in such a condition that it cannot be displaced in the front-rear directions or in the vertical directions.

The restricting member 13 is fitted to the support bracket 11 by a fastening member 14. More specifically, the fastening member 14 includes a screw portion (not shown) in which a male screw is formed, and a manipulating member 14*a*, which is a knob provided at the upper end. On the other hand, a through-hole (not shown) is formed in the restricting member 13. Also, a female thread hole (not shown) is formed in the upper surface of the upwardly extending portion 11*a* of the support bracket 11. The screw portion of the fastening member 14 is inserted in the through-hole, and this securing portion is also inserted in the female thread hole of the support bracket 11. As a result, the restricting member 13 is secured to the support bracket 11.

The size of the support bracket 11 from the lowermost portion of the catch portion 11*c* to the upper end of the upwardly extending portion 11*a* is slightly smaller than the outer diameter of the support member 7. Therefore, when rotating and fastening the fastening member 14 by manipulating the manipulating member 14*a*, the restricting member 13 is brought into such a state as to apply a pressing force against the support member 7 from above toward the catch portion 11*c*. Thus, the support member 7 is clamped by the restricting member 13 and the catch portion 11*c* and is made non-rotatable. In other words, the support member 7 is made non-rotatable around the axial line parallel to the extending direction thereof.

This means that the support member 7 is made rotatable when it is released from the clamped state. More specifically, by rotating the fastening member 14 in the opposite direction to the direction in which it is screwed, the restricting member 13 is brought into such a state as not to apply a pressing force against the support member 7. Thus, the support member 7 is released from the state in which it is clamped by the restricting member 13 and the catch portion 11*c* of the support bracket 11. In that condition, the support member 7 is freely rotatable in the catch portion 11*c* of the support bracket 11. In other words, the support member 7 is rotatable around the axial line parallel or substantially parallel to the extending direction thereof. In this condition, when the support member 7 is rotated to change the mounting condition of the support member 7, the contacting position of the tension relieving member 8 with the fabric CL regarding the circumferential direction, i.e., the position of the contacting portion 81, is changed, and the position of the elastic portion 82 is accordingly changed.

In the following, the operations of the tension fluctuation alleviating device 6 in the printing apparatus according to the present preferred embodiment will be described with reference to FIGS. 4*a* through 4*c*, in comparison with the case in which the tension fluctuation alleviating device 6 is not provided.

As described previously, the printing apparatus 10 of the present preferred embodiment performs printing by the print head 5*a* in the printing mechanism 5 with the sending roll 1*c* and the feed roll 3 being halted, and thereafter, an intermittent feeding operation of the fabric CL to the printing mechanism 5 is performed by simultaneously driving the feeding motor M1 to rotate the sending roll 1*c* and the drive motor M3 to rotate the feed roll 3. Although the printing apparatus 10 of the present preferred embodiment is one that pulls the fabric CL by driving the sending roll 1*c*, the start of rotation of the sending roll 1*c* may delay relative to the start of rotation of the feed roll 3, which pulls the fabric CL, due to the response delay in the control process or the adverse effect of the inertia caused by the weight of the supply roll 1*a*.

If the printing apparatus 10 does not have the tension fluctuation alleviating device 6, the tension of the fabric CL significantly increases temporarily in the path from the sending roll 1*c* to the feed roll 3 because of the delay in the start of rotation of the sending roll 1*c*. In particular, in the printing apparatus 10, the fabric CL that is fed from the fabric supplying device 1 is wrapped around the support roll 4 to change the direction thereof toward the printing mechanism 5. Consequently, because of the increase in tension, the friction force between the fabric CL and the outer circumferential surface of the support roll 4 increases. This causes the fabric CL to be difficult to slide on the support roll 4, increasing the tension of the fabric CL in the printing mechanism 5. As a consequence, elongation occurs in the fabric CL, causing printing misalignment, as already described in the Background Art section.

Figure 4A:
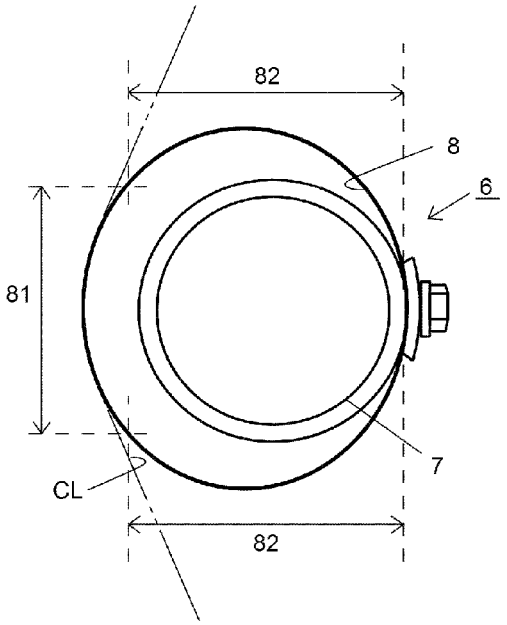
FIGS. 4*a*, 4*b*, and 4*c* are side views of the tension fluctuation alleviating device, which respectively show the cases where the tension of the fabric is normal, where the tension is low, and where the tension is maximum.
Figure 4B:
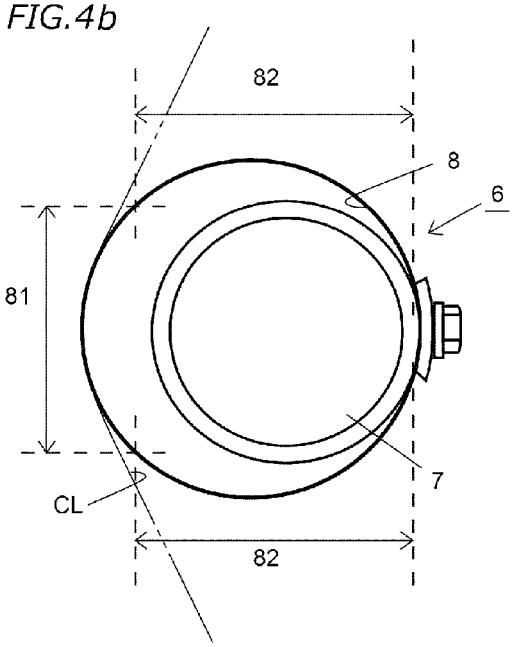
Figure 4C:
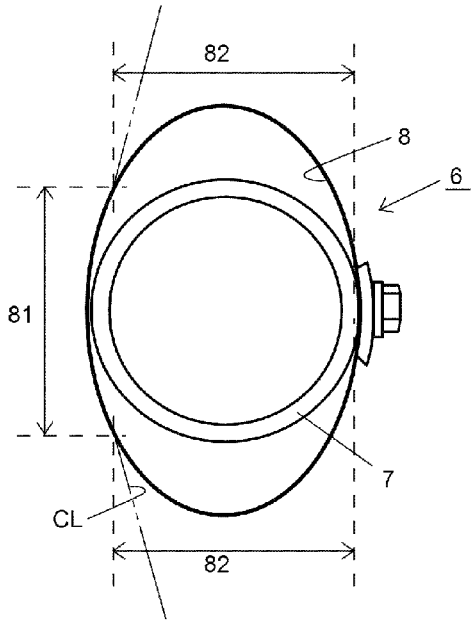

On the other hand, if the printing apparatus 10 includes the tension fluctuation alleviating device 6, the tension relieving member 8 of the tension fluctuation alleviating device 6 elastically receives the tension of the fabric CL (see FIG. 4*a*). Accordingly, as the tension of the fabric CL increases as described above, the tension relieving member 8 undergoes elastic deformation and thus absorbs the tension fluctuation (see FIG. 4*c*).

More specifically, in the tension fluctuation alleviating device 6, the pressing force applied to the tension relieving member 8 that is caused by the tension of the fabric CL is in balance with the elastic force of the elastic portion 82 of the tension relieving member 8. Then, as the tension of the fabric CL increases as described above, the just-mentioned pressing force accordingly increases. Accordingly, the contacting portion 81 of the tension relieving member 8 is pressed by the fabric CL with a greater pressing force from the balanced state as described above, causing the elastic portion 82 to undergo elastic deformation. Thus, the contacting portion 81 is displaced correspondingly to the elastic deformation volume of the elastic portion 82. As a result, the path length of the fabric CL between the sending roll 1*c* and the support roll 4 becomes shorter. The shortening of the path length results in a loosening effect, which alleviates the tension increase of the fabric CL.

Therefore, even when a delay occurs in the movement of the sending roll 1*c* as described above, the resulting tension increase of the fabric CL is alleviated, and printing misalignment resulting from the elongation of the fabric CL due to the just-mentioned tension increase is prevented. In addition, when the tension of the fabric CL decreases for some reason, the contacting portion 81 of the tension fluctuation alleviating device 6 is displaced rearwardly; that is, the tension relieving member 8 undergoes elastic deformation so as to make the path length of the fabric CL longer, contrary to the above-described case (see FIG. 4*b*). As a result, the tension decrease of the fabric CL is alleviated.

In addition, in the tension fluctuation alleviating device 6 according to the present preferred embodiment, both the elastic portion 82 and the contacting portion 81 of the tension relieving member 8 preferably are divided into a plurality of portions in the width direction. Each of the partial elastic portions 82*a* undergoes elastic deformation independently from the adjacent one of the partial elastic portions 82*a*. This means that, when the tension of the fabric CL is not constant along the width direction, each of the partial elastic portions 82*a* elastically receives the tension of the fabric CL according to the tensions of the respective portions of the fabric CL along the width direction. Each of the partial elastic portions 82*a* independently deals with such a tension fluctuation, so that the tension of the fabric CL is made uniform or substantially uniform over the width direction.

The tension relieving member 8 of the present preferred embodiment includes a plurality of tubular members 8*a* each having a short width dimension. The tension relieving member 8 of the present preferred embodiment is easier to handle in fabricating the tension fluctuation alleviating device 6 than the tension relieving member 8 including a single tubular member having a length corresponding to the width dimension of the fabric CL, which makes it possible to reduce the workload required in the fabrication.

Moreover, the tension fluctuation alleviating device 6 of the present preferred embodiment is capable of changing the positions of the contacting portion 81 and the elastic portion 82 relative to the support bracket 11 by rotating the support member 7 by a desired angle to change the mounting condition of the support member 7 to the support bracket 11 regarding the circumferential direction of the tension relieving member 8.

More specifically, changing the position of the contacting portion 81 regarding the circumferential direction of the tension relieving member 8 alters the positional relationship between the contacting portion 81 and the mounting position of the tension relieving member 8 to the support member 7. As a consequence, the length of the elastic portion 82 (i.e., the circumferential distance from the mounting position to the end portion the contacting portion 81 of the tension relieving member 8) changes. Because the length of the elastic portion 82 changes in this way, the elastic deformation volume of the tension relieving member 8 against the tension of the fabric CL (i.e., the displacement magnitude of the contacting portion 81 toward the support member 7 side) changes.

Figure 6B:
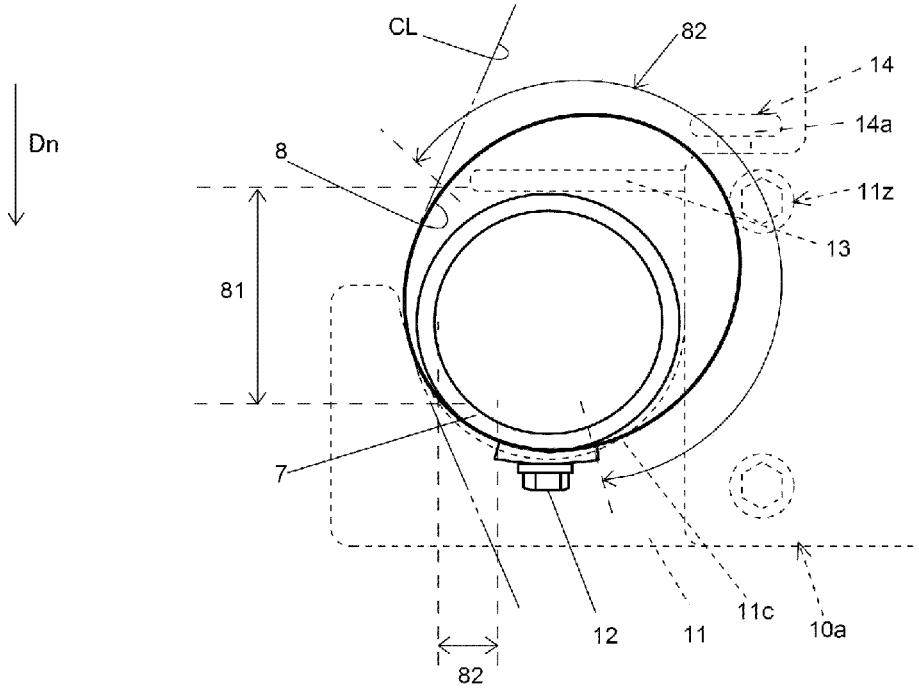
FIG. 6*b* is a side view of the tension fluctuation alleviating device that is installed in a different way.

As an example thereof, FIG. 6*a* shows a mounting condition in which the support member 7 is supported on the support bracket 11 so that the mounting bolt 12 faces frontward. FIG. 6*b* shows a mounting condition in which the support member 7 is supported on the support bracket 11 so that the mounting bolt 12 faces downward, as a result of the change of the mounting condition in such a manner described above. Reference character Fr in FIG. 6*a* indicates frontward, and reference character Dn in FIG. 6*b* indicates downward. Under the condition shown in FIG. 6*a* in which the mounting bolt 12 is facing frontward, the fabric CL makes contact with the tension relieving member 8 at the exactly opposite position to the position of the mounting bolt 12 along the circumference direction of the tension relieving member 8, in the example shown in the figure. That is, under the condition shown in FIG. 6*a*, the center of the contacting portion 81 along the circumferential direction is positioned at a symmetric position for the position of the mounting bolt 12 with respect to the front-rear direction. Therefore, under the mounting condition shown in FIG. 6*a*, the above-mentioned lengths of the pair of elastic portions 82, 82 are the same or approximately the same. That is, the two elastic portions 82, 82 have the same or substantially the same elasticity, and the elastic deformation volumes of the two elastic portions 82, 82 for a tension change of the fabric CL becomes the same or substantially the same.

On the other hand, under the mounting condition shown in FIG. 6*b*, the position of the contacting portion 81 regarding the circumferential direction of the tension relieving member 8 is at a position close to the position of the mounting bolt 12 on one circumferential side thereof, unlike the case with the mounting condition shown in FIG. 6*a*. This means that the front-to-rear lengths of the two elastic portions 82, 82 are different, unlike the case with the mounting condition shown in FIG. 6*a*. In other words, in the case of the example shown in this figure, the front-to-rear length of one of the pair of the elastic portions 82, 82 (the front-to-rear length of the elastic portion 82 that is below the contacting portion 81 in the example shown in this figure) becomes shorter than that shown in FIG. 6*a*, and the elasticity of the one of the elastic portions 82 becomes greater than that in the mounting condition shown in FIG. 6*a*. As a result, when receiving the tension of the fabric CL, the displacement magnitude of the contacting portion 81 toward the support member 7 side becomes smaller because of the effect of this elastic portion 82 with a greater elasticity. The entire elastic deformation volume of the tension relieving member 8 is smaller in the case of the mounting condition shown in FIG. 6*b* than in the case of the mounting condition shown in FIG. 6*a*, when the same magnitude of the force caused by the tension of the fabric CL is applied from the fabric CL.

Thus, the tension fluctuation alleviating device 6 of the present preferred embodiment adjusts the elasticity of the elastic portion 82 by changing the above-described mounting condition. As a result, the same tension fluctuation alleviating device 6 can be used, for example, even when printing needs to be performed on a plurality of types of fabrics CL with different elongation volumes, or when printing needs to be performed on a single type of fabric CL but with different tension conditions.

One preferred embodiment of the present invention has been described above. However, the present invention is not limited to the foregoing preferred embodiment, but may also be embodied in other forms such as described below.

In the foregoing preferred embodiment, the tension relieving member 8 has a configuration in which both the elastic portion 82 and the contacting portion 81 are divided into a plurality of portions in the width direction. In other words, the elastic portion 82 and the contacting portion 81 are provided by a plurality of partial elastic portions 82*a* and a plurality of partial contacting portions 81*a*, which are independent of each other. However, the tension relieving member is not limited to this configuration but may have a configuration as follows.

Figure 7A:
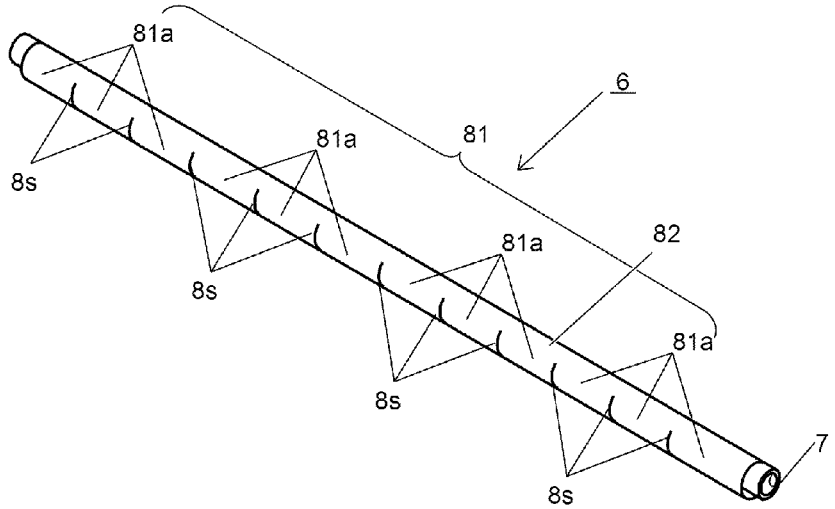
FIG. 7*a* is a perspective view illustrating a tension fluctuation alleviating device according to another preferred embodiment of the present invention.
Figure 7B:
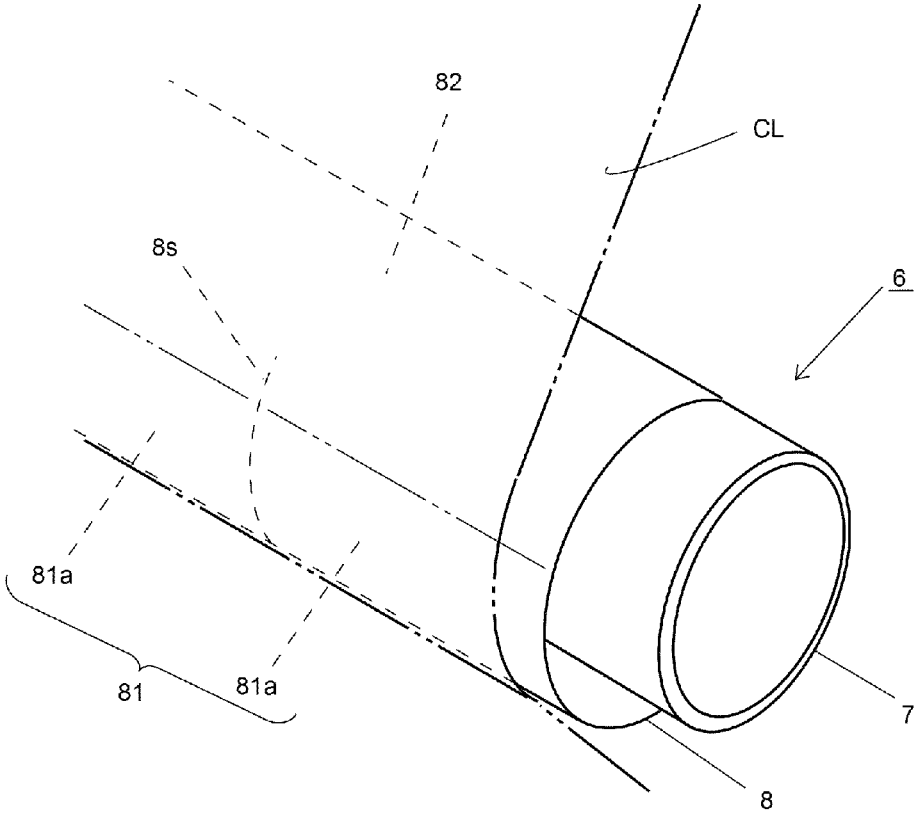
FIG. 7*b* is a perspective view illustrating a portion of the tension fluctuation alleviating device enlarged.

For example, the tension relieving member may have a configuration shown in FIGS. 7*a* and 7*b*. In the example shown in FIGS. 7*a* and 7*b*, the contacting portion 81 includes a plurality of partial contacting portions 81*a*, as in the foregoing preferred embodiment. The elastic portion 82 is preferably formed integrally with the contacting portion 81 so as to be connected with all the partial contacting portions 81*a*. More specifically, in the example shown in the figures, the tension relieving member 8 is constructed preferably by forming an elastic material into a tubular shape, as in the foregoing preferred embodiment. The elastic material has a width dimension required for the tension relieving member 8. In the example shown in the drawings, the elastic material includes slits 8*s* that are arranged in the circumferential direction over a slightly large region than the region corresponding to the contacting portion 81. The contacting portion 81 has such a configuration as to be divided into a plurality of portions in the width direction, that is, a configuration including a plurality of partial contacting portions 81*a*. In contrast, the elastic portion 82 has a configuration in which only the portions near the contacting portion 81 are divided and the rest of the portion is united in one piece.

Such a configuration also makes the tension of the fabric CL uniform or substantially uniform over the width direction because the tension relieving member can deal with the tension fluctuation partially independently. It should be noted that the configuration in which the elastic portion 82 is partially divided is not limited to the one in which only the portion near the contacting portion 81 is divided. It is also possible that the elastic portion 82 may be divided as appropriate within the region extending from the mounting position on the support member 7 to the contacting portion 81.

In addition, the tension relieving member is not limited to the preferred embodiments in which the contacting portion 81 is divided into a plurality of portions regarding the width direction and the elastic portion 82 is divided at least within a region along the circumferential direction thereof (within the region extending from the mounting position on the support member 7 to the contacting portion 81), as in the examples shown in the foregoing preferred embodiments and FIGS. 7*a* and 7*b*. The tension relieving member may also be such that the contacting portion 81 and the elastic portion 82 are formed integrally with each other across the width direction.

Figure 8:
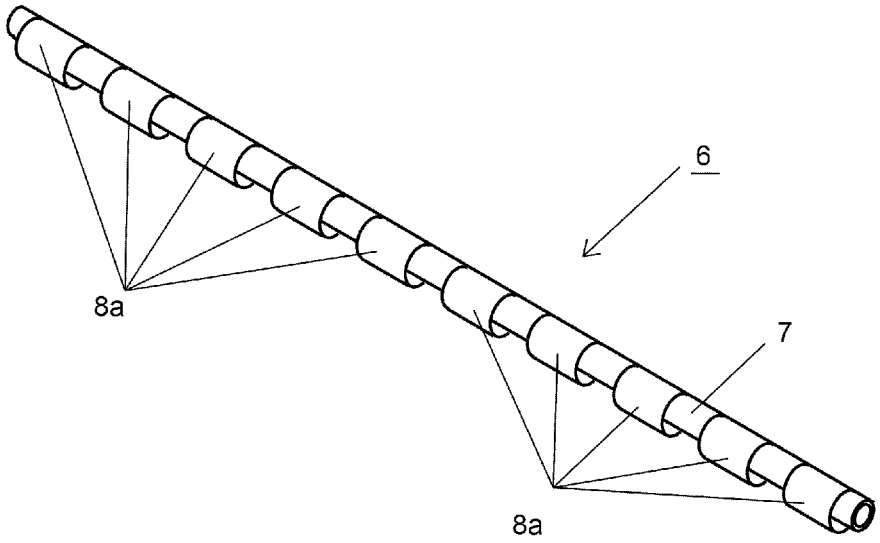
FIG. 8 is a perspective view of a tension fluctuation alleviating device according to still another preferred embodiment of the present invention.

In addition, when the contacting portion 81 and the elastic portion 82 are divided into a plurality of portions regarding the width direction as in a foregoing preferred embodiment, in other words, when the tension relieving member includes a plurality of tubular members 8*a*, the plurality of tubular members 8*a* are not limited to those having such a configuration that the partial contacting portions 81*a* and the partial elastic portions 82*a* are connected with no gaps therebetween along the width direction. For example, as illustrated in FIG. 8, the tubular members 8*a* adjacent to each other may be spaced apart in the width direction.

When feeding a fabric intermittently, the tension fluctuation of the fabric is not always constant but may be varied. For example, a possible cause of the tension fluctuation of the fabric is an effect of inertia accompanied by the operations of the supply roll. As the fabric wrapped around the supply roll is consumed, the weight of the supply roll including the fabric changes. Consequently, the inertia may change, and the fluctuation range of tension may also change accordingly. Moreover, not only such an effect of inertia but also mechanical problems may cause some changes in the operations of the supply roll temporarily, and consequently a large abnormal tension fluctuation may occur temporarily.

Normally, when a large tension fluctuation is expected, it may appear possible to form the elastic portion using an elastic material having a great elasticity so as not to cause such a situation that the elastic portion undergoes elastic deformation to the limit and the tension fluctuation cannot be alleviated. In that case, however, since the elasticity of the elastic portion is great, the elastic portion cannot deal with smaller tension fluctuations, so tension fluctuations in a smaller fluctuation range may not be alleviated. On the other hand, if the elastic portion is formed by an elastic material having a smaller elasticity, the tension fluctuations in a large fluctuation range such as described above may not be alleviated.

In view of that, it is possible to provide a supplementary elastic portion configured to receive the effect of tension of the fabric when the tension fluctuation of the fabric becomes greater than a certain level, such that the tension fluctuation is alleviated only by the elastic portion when the fluctuation range of tension is small, while the supplementary elastic portion receives the effect of the tension of the fabric and undergoes elastic deformation when the elastic deformation of the elastic portion becomes great as the fluctuation range of the tension becomes larger.

Figure 9A:
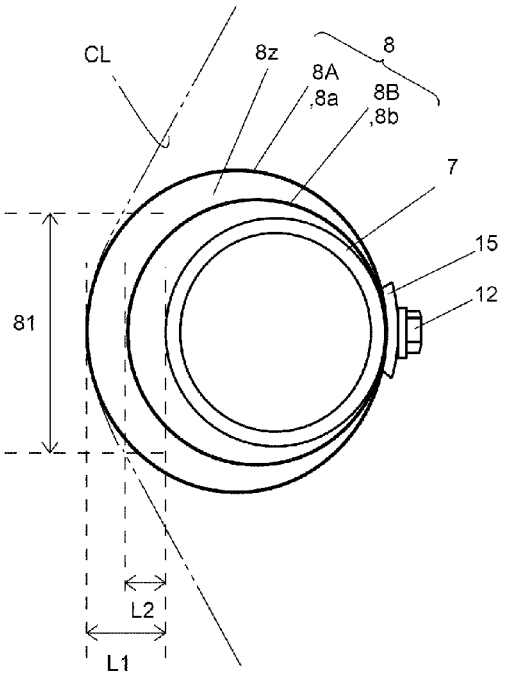
FIG. 9*a* is a side view illustrating a tension fluctuation alleviating device according to still another preferred embodiment of the present invention, which illustrates the case in which the tension of the fabric is normal.
Figure 9B:
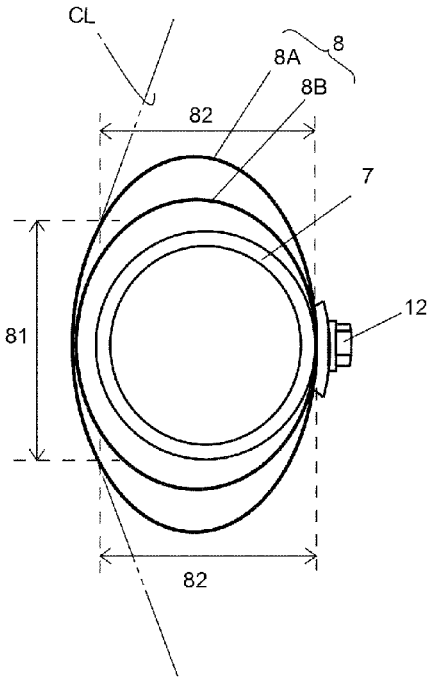
FIG. 9*b* is a side view illustrating the tension fluctuation alleviating device in the case in which the tension of the fabric is high.
Figure 9C:
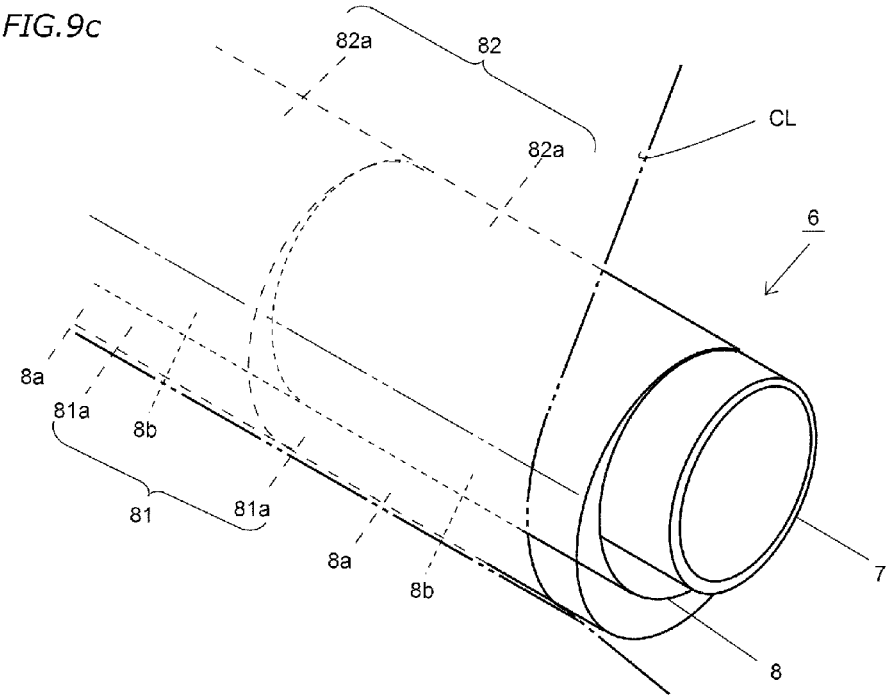
FIG. 9*c* is a perspective view illustrating the tension fluctuation alleviating device in the case in which the tension of the fabric is normal.

For example, as illustrated in FIGS. 9*a* through 9*c*, in addition to the configuration corresponding to the tension relieving member 8 described in the foregoing preferred embodiments (the tubular elastic material including the elastic portion 82 and the contacting portion 81, hereinafter referred to as an "outer elastic body 8A"), it is possible to include a supplementary elastic portion 8B supported by the support member 7 inside the outer elastic body 8A and spaced farther away from the fabric CL than the contacting portion 81. The details of the configuration of the example shown in FIGS. 9*a* through 9*c* are as follows.

The supplementary elastic portion 8B is preferably formed by an elastic material into a tubular shape, like the outer elastic body 8A. The outer elastic body 8A in this example has the same configuration as the tension relieving member 8 of the foregoing preferred embodiments. That is, the outer elastic body 8A is divided in the width direction and includes a plurality of tubular members 8*a* juxtaposed in the width direction.

The supplementary elastic portion 8B is configured to have a smaller diameter than the outer elastic body 8A. The outer diameter of the supplementary elastic portion 8B is smaller than the inner diameter of the outer elastic body 8A. The supplementary elastic portion 8B is configured to have the same width dimension as the outer elastic body 8A, and is divided into a plurality of portions in the width direction, as in the case of the outer elastic body 8A. That is, the supplementary elastic portion 8B includes a plurality of divided portions 8*b* juxtaposed in the width direction. The width dimension of each of the divided portions 8*b* of the supplementary elastic portion 8B is the same or substantially the same as the width dimension of each of the tubular members 8*a* of the outer elastic body 8A. Each of the divided portions 8*b* of the supplementary elastic portion 8B is disposed in each of the tubular members 8*a* of the outer elastic body 8A (i.e., in the hollow portion 8*z*). Each of the divided portions 8*b* is mounted to the support member 7 in the same mounting condition as each of the tubular members 8*a*. The divided portions 8*b* and the tubular members 8*a* are mounted commonly to respective mounting positions in the support member 7.

More specifically, the supplementary elastic portion 8B is disposed inside the outer elastic body 8A, and the support member 7 is disposed inside the supplementary elastic portion 8B. The outer elastic body 8A, the supplementary elastic portion 8B, and the support member 7 are stacked on top of each other, and the stacked portion is secured by the mounting bolt 12 via the retainer 15, which is disposed on the outside thereof. The supplementary elastic portion 8B is fitted to the support member 7 so that, regarding the width direction, the divided portions 8*b* are disposed at matching positions with the tubular members 8*a* of the outer elastic body 8A. As a result, the supplementary elastic portion 8B is decentered relative to the support member 7, in the same way as the outer elastic body 8A. In addition, because the supplementary elastic portion 8B has a smaller diameter than the outer elastic body 8A, the distance L2 from the support member 7 to an edge portion of the supplementary elastic portion 8B on the fabric CL side is shorter than the distance L1 from the support member 7 to an edge portion of the outer elastic body 8A on the fabric CL side (more specifically, the edge portion of the contacting portion 81 on the fabric CL side). Therefore, the supplementary elastic portion 8B is spaced farther away from the fabric CL than the contacting portion 81 (see FIG. 9*a*).

Thus, in this configuration, when the tension fluctuation of the fabric CL becomes greater than a certain level and the outer elastic body 8A undergoes large elastic deformation, the inner circumferential surface of the outer elastic body 8A comes into contact with the outer circumferential surface of the supplementary elastic portion 8B, and both the outer elastic body 8A and the supplementary elastic portion 8B receive the tension of the fabric CL (see FIG. 9*b*). When the fluctuation range of tension is small, the tension fluctuation is alleviated only by the elasticity of the elastic portion 82 of the outer elastic body 8A. When the fluctuation range of tension is large, the tension fluctuation of the fabric CL is alleviated by the combined elasticity of the elasticity of the elastic portion 82 and the elasticity of the supplementary elastic portion 8B. As a result, it is possible to deal with a greater fluctuation of the tension of the fabric CL in the printing process in comparison with the configuration of only the outer elastic body 8A.

The tension relieving member 8 is not limited to the example shown in FIGS. 9*a* through 9*c*. For example, the tension relieving member 8 is not limited to that in which the outer elastic body 8A is divided in the width direction, but the outer elastic body 8A may be formed integrally across the width direction. In this case, the supplementary elastic portion 8B may or may not be divided in the width direction as in the examples shown in FIGS. 9*a* through 9*c*, and the supplementary elastic portion 8B may be formed integrally across the width direction.

Moreover, in the case where the tension relieving member includes the supplementary elastic portion, the tension relieving member is not limited to the one in which the supplementary elastic portion 8B is disposed inside the outer elastic body 8A, as in the example shown in FIGS. 9*a* through 9*c*. It is also possible that the outer elastic body 8A and the supplementary elastic portion 8B may be disposed alternately along the width direction, as shown in FIGS. 10*a* and 10*b*.

Figure 10A:
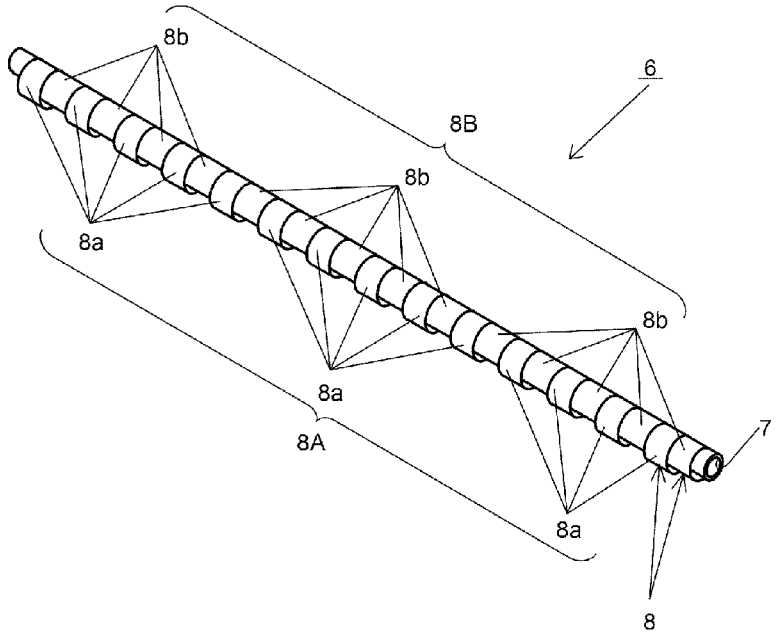
FIG. 10*a* is a perspective view illustrating a tension fluctuation alleviating device according to yet another preferred embodiment of the present invention.
Figure 10B:
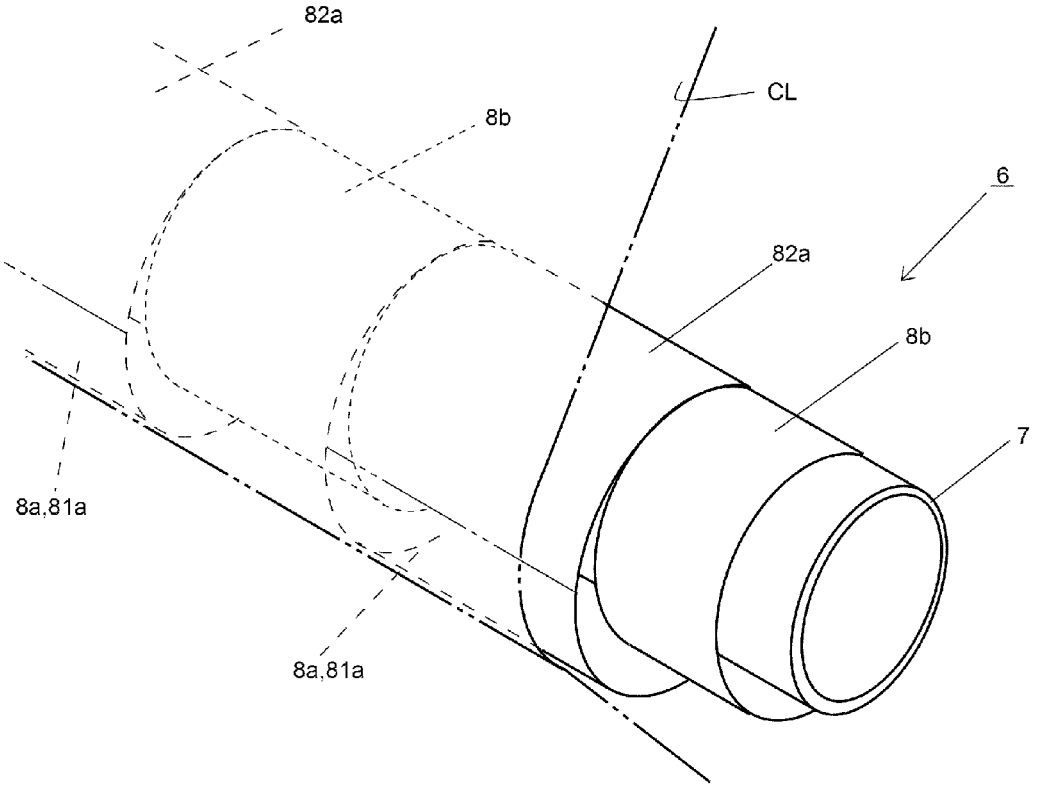
FIG. 10*b* is a perspective view illustrating a portion of the tension fluctuation alleviating device enlarged.

In the example shown in FIGS. 10*a* and 10*b*, the outer elastic body 8A includes a plurality of tubular members 8*a* divided in the width direction. The plurality of tubular members 8*a* are spaced apart in the width direction. The supplementary elastic portion 8B includes a plurality of divided portions 8*b* divided in the width direction. The plurality of divided portions 8*b* are spaced apart in the width direction. The gap between the tubular members 8*a* of the outer elastic body 8A is set to be the same or substantially the same as the width dimension of the divided portions 8*b* of the supplementary elastic portion 8B. Each of the tubular members 8*a* of the outer elastic body 8A is disposed in a space between the adjacent divided portions of the supplementary elastic portion 8B. Thus, the tension relieving member 8 in the example shown in FIGS. 10*a* and 10*b* is such that the plurality of tubular members 8*a* constituting the outer elastic body 8A and the plurality of divided portions 8*b* constituting the supplementary elastic portion 8B are disposed alternately regarding the width direction.

In the tension relieving member 8 of the example shown in FIGS. 10*a* and 10*b* as well as in the case of the example shown in FIGS. 9*a* through 9*c*, when the fluctuation range of tension is small, the tension fluctuation is alleviated only by the elasticity of the elastic portion 82 of the outer elastic body 8A, that is, the elasticity of the partial elastic portions 82*a* of the tubular members 8*a*. When the fluctuation range of tension is large, the tension fluctuation of the fabric CL is alleviated by the combined elasticity of the elasticity of the elastic portion 82 of the outer elastic body 8A and the elasticity of the supplementary elastic portion 8B. Therefore, the example shown in FIGS. 10*a* and 10*b* obtains the same advantageous effects as the example shown in FIGS. 9*a* through 9*c*.

In the examples described hereinabove, the tension relieving member is such that the elastic portion and the contacting portion are preferably formed integrally with each other (more specifically, formed integrally with each other in a tubular shape), but the tension relieving member is not limited thereto. The tension relieving member may include an elastic portion and a contacting portion that are separate elements, and the contacting portion may be fitted to an end portion of the elastic portion on the fabric side (an end portion thereof opposite to the support member side). For example, the elastic portion may be made by forming an elastic material into a tubular shape, and another member that forms the contacting portion may be fitted to the outer circumferential surface of the tubular elastic portion. In addition, in the case where the elastic portion and the contacting portion are separate elements and both the elastic portion and the contacting portion are divided in the width direction, the divided portions of the elastic portion and those of the contacting portion may not necessarily have the same width dimension, and the width dimension of one of them may be smaller than that of the other.

Moreover, the tension relieving member is not limited to the ones in which the elastic portion is formed by a portion or the entirety of the elastic material formed in a tubular shape as in the foregoing examples, but may be such members as shown in FIGS. 11*a* through 11*d*. The details are as follows.

Figure 11A:
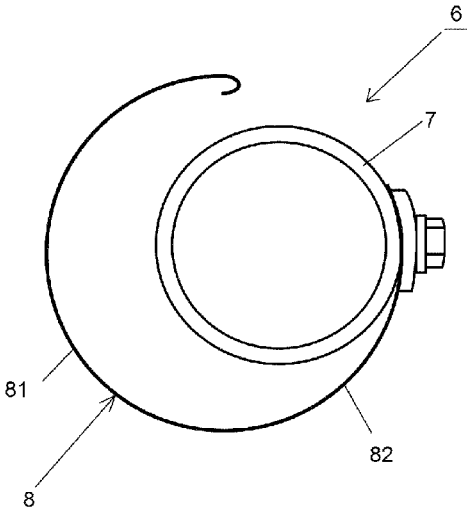
FIGS. 11*a*, 11*b*, 11*c*, and 11*d* are side views illustrating tension fluctuation alleviating devices according to still other preferred embodiments of the present invention.

The tension relieving member 8 of the foregoing preferred embodiments is such that it preferably has a circular or substantially circular cross-sectional shape and elastic portions 82 are positioned on both circumferential sides of the contacting portion 81, which occupies a portion of the tension relieving member along the circumferential direction. In other words, the tension relieving member 8 of the foregoing preferred embodiments includes a pair of elastic portions 82. Instead, one of the elastic portions 82, 82 may be eliminated, and it is possible to use or adopt a configuration in which the elastic portion 82 is connected to only one end portion of the contacting portion 81 along the circumferential direction as illustrated in FIG. 11*a*, in other words, a configuration in which the whole member has a C-shaped or substantially C-shaped cross-sectional shape.

Figure 11B:
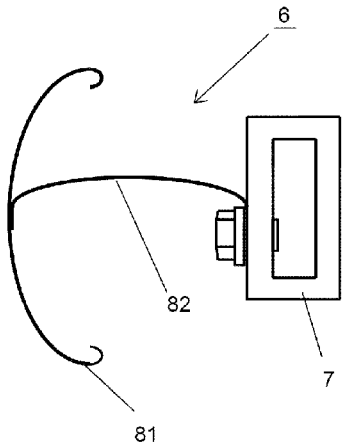

Alternatively, in the case where the elastic portion 82 and the contacting portion 81 are defined by separate elements, the tension relieving member 8 may have a configuration as shown in FIG. 11*b*. In the example shown in FIG. 11*b*, a plate-shaped elastic portion 82 extends from the support member 7 toward the fabric CL, as viewed from side. The elastic portion 82 extends in a direction intersecting the path of the fabric CL. A plate-shaped contacting portion 81 extending along the path of the fabric CL (i.e., so as to bulge rearwardly in a circular arc shape) is fitted to an end portion of the elastic portion 82 on the fabric CL side.

Figure 11C:
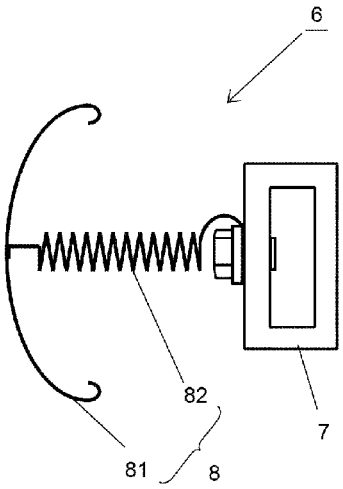

In place of the plate-shaped elastic material shown in FIG. 11*b*, the elastic portion 82 extending from the support member 7 toward the fabric CL and extending in a direction intersecting the path of the fabric CL may be a spring member, such as a coil spring, as shown in FIG. 11*c*.

Figure 11D:
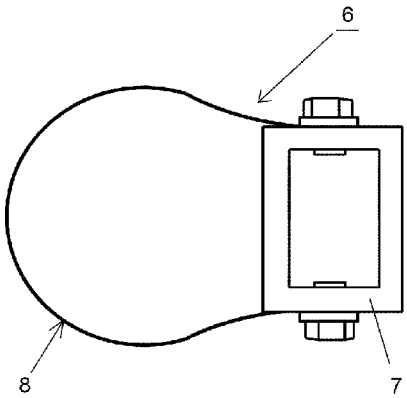

In addition, the tension relieving member 8 is not limited to the ones having a tubular shape, but may be an elastic material having a U-shaped or substantially U-shaped cross-sectional shape, as shown in FIG. 11*d*. In this case, the opposite ends of this tension relieving member 8 having a U-shaped or substantially U-shaped cross-sectional shape may be secured to the support member 7 by mounting bolts 12, for example.

In the above-described examples shown in FIGS. 11*a*, 11*b*, 11*c*, and 11*d* as well, the tension relieving member 8 may be divided into a plurality of portions in the width direction, or may be formed integrally across the width direction.

When it is unnecessary to change the mounting condition of the tension relieving member 8 in such a way described in the foregoing preferred embodiments, the support member 7 need not be cylindrical or substantially cylindrical. It may have a quadrangular or substantially quadrangular cross-sectional shape as shown in FIGS. 11*b*, 11*c*, and 11*d*, or it may be a rod having a polygonal cross-sectional shape, for example.

The printing apparatus 10 to be equipped with the tension fluctuation alleviating device is not limited to the ones described in the foregoing preferred embodiments, but may be one having any other configuration to feed the fabric CL intermittently to the printing mechanism 5. For example, the sending roll 1*c*, which is a separate roll from the supply roll 1*a* around which the fabric CL is wound, is driven in the fabric supplying device 1 in the foregoing preferred embodiments. Instead, it is possible that the supply roll 1*a* may be driven and rotated by the feeding motor M1. In this case, the sending roll 1*c* and the feeding-side guide roll 1*b* may be eliminated.

It is also possible that the feeding motor M1 as well as the sending roll 1*c* may be eliminated so that the supply roll 1*a* is indirectly driven according to the conveying operation of the fabric CL performed by the feed roll 3. Moreover, it is also possible that only the take-up roll 2*b* is driven so that the fabric CL travels according to the taking-up by the take-up roll 2*b*, causing the supply roll 1*a* to be indirectly driven. In this case, the take-up roll 2*b* is intermittently driven. In this case, the feed roll 3 does not have the function to provide the conveying operation to the fabric CL, but it merely serves as a member to guide the fabric CL. For this reason, the feed roll 3 may be supported non-rotatably.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A tension fluctuation alleviating device for use in a fabric printing apparatus including a fabric supplying device configured to supply a fabric, a printing mechanism configured to perform printing on the fabric supplied from the fabric supplying device, a guide device provided between the fabric supplying device and the printing mechanism and configured to guide the fabric toward the printing mechanism, and a fabric take-up device configured to take up the fabric printed by the printing mechanism, the fabric printing apparatus configured to intermittently send the fabric to the printing mechanism to perform printing on the fabric, the tension fluctuation alleviating device comprising:

a support member located between the fabric supplying device and the guide device and extending across a width direction of the fabric; and a tension relieving member including an elastically deformable elastic portion supported by the support member and extending from the support member toward the fabric, and a contacting portion arranged closer to the fabric than the elastic portion and so as to contact with the fabric; wherein the elastic portion and the contacting portion are integrated with each other;

at least a portion of the elastic portion that is connected to the contacting portion is divided into portions along a width direction; and the contacting portion includes a plurality of partial contacting portions corresponding to the divided portions of the elastic portion.

2. The tension fluctuation alleviating device according to claim 1, wherein the plurality of partial contacting portions are arrayed in the width direction with no gaps therebetween.

3. The tension fluctuation alleviating device according to claim 1, wherein the plurality of partial contacting portions are arrayed so as to be spaced apart from each other in the width direction.

4. The tension fluctuation alleviating device according to claim 1, wherein the elastic portion includes a plurality of elastic portions arrayed in the width direction and each supported by the support member.

5. The tension fluctuation alleviating device according to claim 1, wherein the support member is rotatable around an axial line parallel or substantially parallel to the width direction of the fabric.

6. The tension fluctuation alleviating device according to claim 1, wherein the tension relieving member includes a tubular elastic material.

7. A tension fluctuation alleviating device for use in a fabric printing apparatus including a fabric supplying device configured to supply a fabric, a printing mechanism configured to perform printing on the fabric supplied from the fabric supplying device, a guide device provided between the fabric supplying device and the printing mechanism and configured to guide the fabric toward the printing mechanism, and a fabric take-up device configured to take up the fabric printed by the printing mechanism, the fabric printing apparatus configured to intermittently send the fabric to the printing mechanism to perform printing on the fabric, the tension fluctuation alleviating device comprising:

a support member located between the fabric supplying device and the guide device and extending across a width direction of the fabric; and a tension relieving member including an elastically deformable elastic portion supported by the support member and extending from the support member toward the fabric, and a contacting portion arranged closer to the fabric than the elastic portion and so as to contact with the fabric; wherein the tension relieving member includes a supplementary elastic portion supported by the support member; and a distance from the support member to an edge portion of the supplementary elastic portion on a fabric side is shorter than a distance from the support member to an edge portion of the contacting portion on the fabric side.

8. The tension fluctuation alleviating device according to claim 7, wherein the support member is rotatable around an axial line parallel or substantially parallel to the width direction of the fabric.

9. The tension fluctuation alleviating device according to claim 7, wherein the tension relieving member includes a tubular elastic material.

10. A tension fluctuation alleviating device for use in a fabric printing apparatus including a fabric supplying device configured to supply a fabric, a printing mechanism configured to perform printing on the fabric supplied from the fabric supplying device, a guide device provided between the fabric supplying device and the printing mechanism and configured to guide the fabric toward the printing mechanism, and a fabric take-up device configured to take up the fabric printed by the printing mechanism, the fabric printing apparatus configured to intermittently send the fabric to the printing mechanism to perform printing on the fabric, the tension fluctuation alleviating device comprising:

a support member located between the fabric supplying device and the guide device and extending across a width direction of the fabric; and a tension relieving member including an elastically deformable elastic portion supported by the support member and extending from the support member toward the fabric, and a contacting portion arranged closer to the fabric than the elastic portion and so as to contact with the fabric; wherein the support member is configured so that a mounting position thereof is changeable around an axial line parallel or substantially parallel to the width direction of the fabric.

11. The tension fluctuation alleviating device according to claim 10, wherein the support member is rotatable around an axial line parallel or substantially parallel to the width direction of the fabric.

12. The tension fluctuation alleviating device according to claim 10, wherein the tension relieving member includes a tubular elastic material.

* * * * *